US005813566A

United States Patent [19]

Bradford et al.

[11] Patent Number: 5,813,566

[45] Date of Patent: Sep. 29, 1998

[54] DAMAGE RESISTANT CONTAINER AND SLEEVE PACK ASSEMBLY

[75] Inventors: Judson A. Bradford, Holland; Donald J. Bazany, Grand Haven; Bruce H. Landheer, Jenison, all of Mich.

[73] Assignee: Bradford Company, Holland, Mich.

[21] Appl. No.: 501,613

[22] Filed: Jul. 12, 1995

[51] Int. Cl.[6] ..... B65D 81/00

[52] U.S. Cl. ..... 220/653; 206/298; 220/1.5

[58] Field of Search ..... 206/298; 220/1.5, 220/653, 652, 651

[56] References Cited

U.S. PATENT DOCUMENTS

| | | | |
|---|---|---|---|
| 935,958 | 10/1909 | Boden | 206/298 |
| 1,712,168 | 5/1929 | Rand, Jr. . | |
| 1,768,467 | 6/1930 | Hutchings et al. . | |
| 2,018,605 | 10/1935 | Craig . | |
| 2,608,339 | 8/1952 | Benzon-Petersen . | |
| 3,467,247 | 9/1969 | Weiss . | |
| 3,902,597 | 9/1975 | Brennan | 206/298 |
| 4,512,477 | 4/1985 | Denson | 206/298 |
| 4,527,694 | 7/1985 | Bolt et al. . | |
| 4,574,950 | 3/1986 | Koe et al. . | |
| 4,685,571 | 8/1987 | Hoss . | |
| 5,211,290 | 5/1993 | Janus et al. . | |

FOREIGN PATENT DOCUMENTS

| | | | |
|---|---|---|---|
| PCT/EP92/02669 | 5/1993 | Germany . | |
| 304438 | 1/1929 | United Kingdom | 206/298 |

OTHER PUBLICATIONS

Conteyor® Sales Brochure (copy).

*Primary Examiner*—Joseph M. Moy
*Attorney, Agent, or Firm*—Wood, Herron & Evans, LLP

[57] ABSTRACT

A sleeve pack for storing and shipping products comprises a body for containing said products having a top, a bottom and opposing sidewalls. The sidewalls of the body are generally flexible to provide an amount of give under a force applied thereto. A telescoping support bar is positioned in the body and spans between the opposing sidewalls for suspending products in the body. The support bar telescopes in length so that the sidewalls may flex inwardly and outwardly when force is applied thereto and further telescopes generally to its original length when the force is removed and the sidewalls return to their original shape. An embodiment of the invention utilizes a support bar mounting structure which functions as an edge rail protecting device.

21 Claims, 2 Drawing Sheets

DAMAGE RESISTANT CONTAINER AND SLEEVE PACK ASSEMBLY

FIELD OF THE INVENTION

The present invention relates generally to reusable containers for suspending pouches of product within and more specifically to an improved, damage-resistant sleeve pack assembly having a collapsible design for better withstanding denting, puncturing and general abuse.

BACKGROUND OF THE INVENTION

Relatively large reusable containers are utilized by manufacturers to ship a variety of different products to their customers. For example, in the automobile industry, a plant assembling a particular automobile might utilize a number of different parts manufacturers. These manufacturers ship their respective parts to the plant in reusable containers where the parts are then assembled together into a finished automobile. The reusable containers are often returned to the parts manufacturers for use in further shipments, thus saving the manufacturers cost of the containers.

The construction of some such shipping containers includes a pallet base, a cover and a rectangular sleeve pack which is situated between the base and cover to form the sidewalls and body of the container. Such a design provides a versatile and lightweight shipping container which may be reused time and again. While some products are simply placed in the containers on the base and against the sidewalls, many products shipped in such containers are more susceptible to being damaged during shipment. Therefore, some available container sleeve pack designs utilize hanging pouches which contain the product and suspend it away from the base or sidewalls of the container. The pouches are flat and usually formed of cloth and are suspended along a top edge thereof by rigid support bars or other structures extending from one side of the container to the other inside the sleeve pack. The successive pouches are arranged in side-by-side fashion and the rigid bars extend generally parallel with each other across the sleeve pack.

When reusable containers are moved, such as during loading and unloading, they are often abused, such as by being crushed or smashed by the forks of a forklift or by some other lifting or moving device. The sleeve pack sidewalls are often punctured or severely dented, making the container unfit for re-use. The container sleeve pack is then either thrown away and replaced or bent back into shape, if possible. Both alternatives are costly and wasteful of time and resources.

Traditionally, the construction of container, and particularly sleeve packs, has been made heavier and more rigid to withstand the abusive forces to which the containers are exposed. For example, the sleeve pack sidewalls are made of thicker, more durable material. Furthermore, the edges and corners along the top, bottom and sides of the sleeve pack are reinforced, such as with metal. In sleeve packs utilizing product pouches, the rigid support bars provide rigidity to the sleeve pack when an impact force occurs at a side to which the bars are anchored. However, despite efforts at reinforcement container sleeve packs are still punctured and dented by heavy machines and thus rendered unusable.

Recently, and against convention, some containers and sleeve packs are being designed with a lighter construction which gives way when the container is abused. For example, the sidewalls of the sleeve pack yield inwardly when a forklift or other machine smashes into the container side. Similarly, the sides will yield outwardly to weight and forces from within. The sidewalls are constructed of a resilient material which returns to its original shape when the force is removed. Since the sidewalls have give, they are less likely to be punctured, and dents may easily be pushed out or are totally eliminated. While resilient sidewalls have eliminated some denting and puncturing, other rigid structures within the sleeve pack still tend to prevent sidewall flexing making the sleeve pack susceptible to permanent damage. Particularly, the rigid bars supporting and suspending the product pouches work against the give of the resilient sidewalls. If the damaging force is strong enough, the unyielding sidewalls are punctured or the bars bend and prevent the sidewalls from returning to their original shape.

Another problem encountered when using reusable sleeve packs is the wear on the edges of the sleeve pack which contact the base and cover. The top and bottom edges are the same resilient materials as the sidewalls and are susceptible to being dented, smashed or otherwise damaged. In sleeve packs using hanging pouches, the top edge is particularly susceptible to being damaged because it must support the weight of the hanging products.

Accordingly, it is an objective of the present invention to provide a reusable container which is more durable and less susceptible to being permanently damaged by abusive handling during use. It is further an objective to prevent permanent damage to containers using sleeve packs which suspend pouches of product within the sleeve pack. It is another objective to protect the delicate edges of the sleeve pack without adding to the overall weight and complexity of the container. It is still another objective to provide a lightweight yet durable sleeve pack and container which is able to withstand the rigors of use.

SUMMARY OF THE INVENTION

The present invention addresses the above-stated objectives by providing a sleeve pack and container for storing and shipping products which is damage resistant and better able to withstand the abusive forces encountered when being moved and handled. To that end, the sleeve pack comprises a body having a top, a bottom and opposing rectangular sidewalls. The sleeve pack body is formed generally in the shape of a rectangle for placement between a base and a cover to form a reusable container. The sidewalls of the body are preferably formed of a single or double layer of plastic corrugated material which is generally flexible to provide a certain amount of give under a force which is applied thereto, such as by a forklift being driven into the sidewall of the sleeve pack. The resilient sidewalls will generally return to their original shape when smashed in or dented, and the give of the sidewalls reduces and prevents puncturing of the sleeve pack.

A plurality of telescoping support bars are positioned in the sleeve pack body and span between two opposing sidewalls. The bars are slidably fixed to the sidewalls proximate the top edge of the sleeve pack. Fabric pouches hang from the support bars and contain the shipped products to suspend the products from the bars. The products are thus suspended above the base and away from the sidewalls of the container. Each telescoping support bar is operable to telescope to a variety of lengths when a force is applied to the end of the bar. The telescoping support bar in combination with the resilient sidewalls provides a container sleeve pack which absorbs damaging forces to prevent permanent damage. That is, when a force outside the container is applied to one of the sidewalls between which the support bar spans, the sidewall flexes inwardly and temporarily shortens the length of the support bar. Similarly, any forces from within the container cause the sidewalls to flex outwardly and increase the effective length of the bar. In that way, and in accordance with the principles of the present invention, pouches of product are suspended within the container and the bars supporting the pouches do not hinder the flexibility and damage resistance of the sleeve pack.

In an embodiment of the invention, the telescoping support bar is biased to telescope and return to an extended length when an inwardly directed force on the sidewalls is removed and the sidewalls return to their original shapes. Alternatively, the support bar might simply telescope back to an extended length under the force of the resilient sidewalls returning to their original shape. In still another embodiment, the bias of the bar returns the telescopically elongated bar to its original shortened position whenever a force directed outwardly of the sleeve pack is removed.

Each end of a support bar is held by an elongated channel extending along the length of a sidewall. The ends of the support bars slidably move within the channels so that the positions of the bars may be adjusted along the sleeve pack sidewall, such as to access a particular, product pouch. Each channel is connected to an elongated mounting structure which engages the top edge of the sleeve pack sidewall to suspend the channel and the support bars proximate the top of the sleeve pack. The sidewalls suspending the support bar are single layered or may be folded over to create double-wall portions along the top edge.

One embodiment of the mounting structure includes a flange connected to the bar channel. The flange is riveted or bolted to the side wall for securement. Another embodiment of the mounting structure includes a hook section which is connected to the bar channel. The hook section hooks over the sidewall top edge and a rivet or bolt extends through the hook section and sidewall for securement.

Another embodiment of the mounting structure includes a hook section and a ridge spaced from the hook section. The hook section hooks over the sidewall top edge and the ridge engages an edge of a double-wall portion which is spaced below the top edge of the sidewall. The bar track is positioned generally between the hook section and ridge, close to the ridge. The hook section and ridge cooperate to thoroughly secure the track to the sidewall. Still another embodiment has opposing flanges on either side of the channel which fit into a slot formed in one of the walls of the double-wall portion.

The mounting structures of the invention utilizing the hook sections function as elongated protective edge rails for the sleeve pack. The edge rail is preferably metal and covers the top edge of the sleeve pack to structurally strengthen the top edge and protect the edge from damage. An alternative embodiment of the edge rail is utilized with sleeve packs which do not support pouches and thus does not include the channel for suspending the support bars. One edge rail of the invention is riveted or bolted for securement and other embodiments are snapped onto a double-wall portion without additional fastening structures.

In one embodiment of the invention, the telescoping support bar comprises a cylindrical exterior tube and two opposing cylindrical rods which fit into the opposite ends of the exterior tube. The opposing rods telescope inside the tube to vary the length of the bar as necessary to adapt to forces applied to the sidewalls. Preferably, the rods slide freely in the tube. Alternatively, a compression spring may be positioned between the rods to bias the rods away from each other when the bar is compressed such that the support bar is loaded to extend to its original length when the compressing force is removed. In another alternative embodiment, the two inward ends of the rods may be attached to the spring to also bias the bar to a shortened position whenever forces inside the sleeve pack extend the bar. Caps on the ends of the bars secure them within the channels of the mounting structures.

Thereby, the damage resistant sleeve pack of the present invention provides a reusable container which is more durable and less susceptible to being permanently damaged by abusive handling during use. The telescoping support bar telescopes in length when force is applied to the sidewalls and prevents permanent denting of the sleeve pack sidewalls and internal structures. Thereby, pouches of product may be suspended within the sleeve pack without detrimentally affecting its damage resistance and without jeopardizing its reusability. The present invention provides a lightweight sleeve pack with enhanced edge protection which is resilient and less prone to being damaged along its edges.

The above and other objects and advantages of the present invention shall be made apparent from the accompanying drawings and the detailed description thereof.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF SPECIFIC EMBODIMENTS

Figure 1:
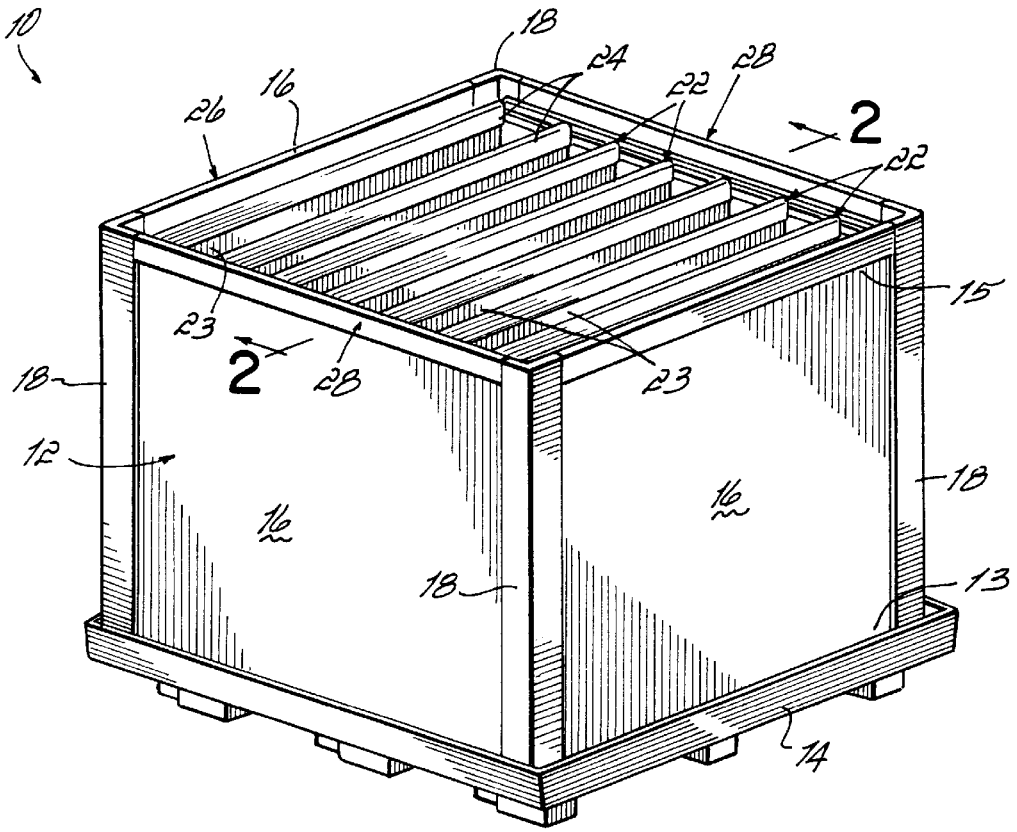
FIG. 1 is a perspective view of the container sleeve pack of the present invention utilizing the telescoping support bar and product pouches.

FIG. 1 illustrates the reusable, damage-resistant container 10 and sleeve pack assembly 12 of the present invention. Container 10 incorporates sleeve pack assembly 12, and the bottom 13 of the sleeve pack rests upon a base or pallet 14. Container 10 also includes a cover (not shown) which is generally similar to base 14 and seals the top 15 of the sleeve pack 12. Container 10 is used to ship and store products for use in manufacturing.

Sleeve pack 12 comprises four generally rectangular sidewalls 16 which may be joined together by corner structures 18 into a sleeve pack structure having a box-like shape. A plurality of support bars 20 (see FIGS. 2 and 3) extend between two opposing sidewalls 16 of the sleeve pack 12. Fabric pouches 22 hang from the support bars 20 and contain product. The product is suspended above the base 14 and away from the sidewalls 16 of the sleeve pack 12. In a preferred embodiment, the pouches are all connected together accordion-style and each pouch has two walls 23 and a bottom (not shown), with adjacent pouches sharing a common wall. Each pouch wall 23 has a fold-over portion 24 which wraps around a support bar 20; therefore, each wall is supported by a bar 20. Access to the pouches 22 is provided between the walls proximate the fold-over portion 24 to allow access to the product from at the top edge 26 of sleeve pack 12. The support bars 20 are suspended by mounting structures 28 which are secured to the opposing sidewalls 16 proximate the top edge 26 thereof.

Figure 3:
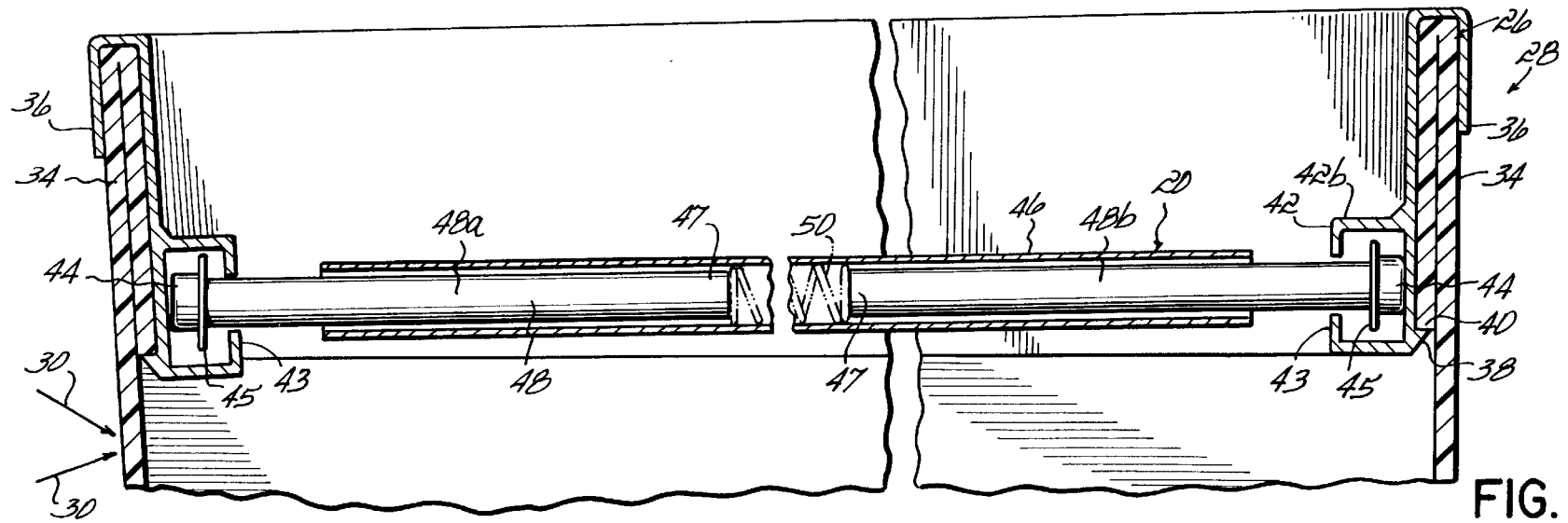
FIG. 3 is a cross-sectional view similar to FIG. 2 illustrating indentation of the sleeve pack sidewalls and telescoping of the extensible support bar.

The sidewalls 16 of sleeve pack 12 are preferably made of a single sheet of plastic corrugated material which is flexible and resilient. Preferably, a single sheet of 10 mm thick material is used, although two sheets of back-to-back 5 mm material might also be used. The sidewalls 16 thereby have an amount of inward or outward give when force is applied thereto. Referring to FIG. 3, for example, when an inward smashing or crushing force (illustrated by arrows 30) is applied to sidewalls 16, such as by a forklift fork (not shown), the sidewall 16 flexes inwardly. Upon removal of the force, the flexible plastic corrugated material would generally return to its original shape. Therefore, the sleeve pack 12 may be temporarily dented, but the dents tend to pop back out as the side wall returns to its original shape to provide a reusable sleeve pack. Additionally, the give of the resilient sidewalls 16 reduces and resists puncturing of the sidewalls.

Alternatively, the sidewalls 16 may be formed of paper corrugated material which is flexible and resilient, although, plastic corrugated materials tends to be more durable and moisture resistant.

Figure 6:
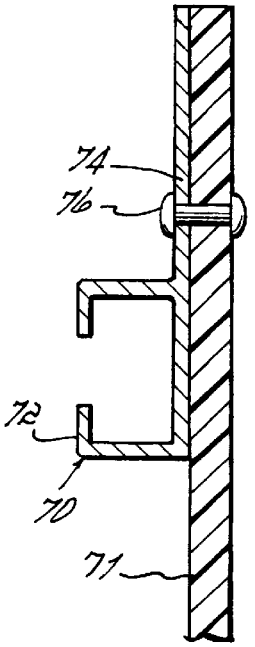
FIG. 6 is a cross-sectional view of an alternative embodiment of a mounting structure of the invention.
Figure 7:
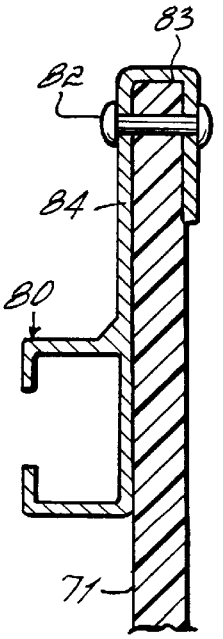
FIG. 7 is a cross-sectional view of an alternative embodiment of a mounting structure of the invention.
Figure 2:
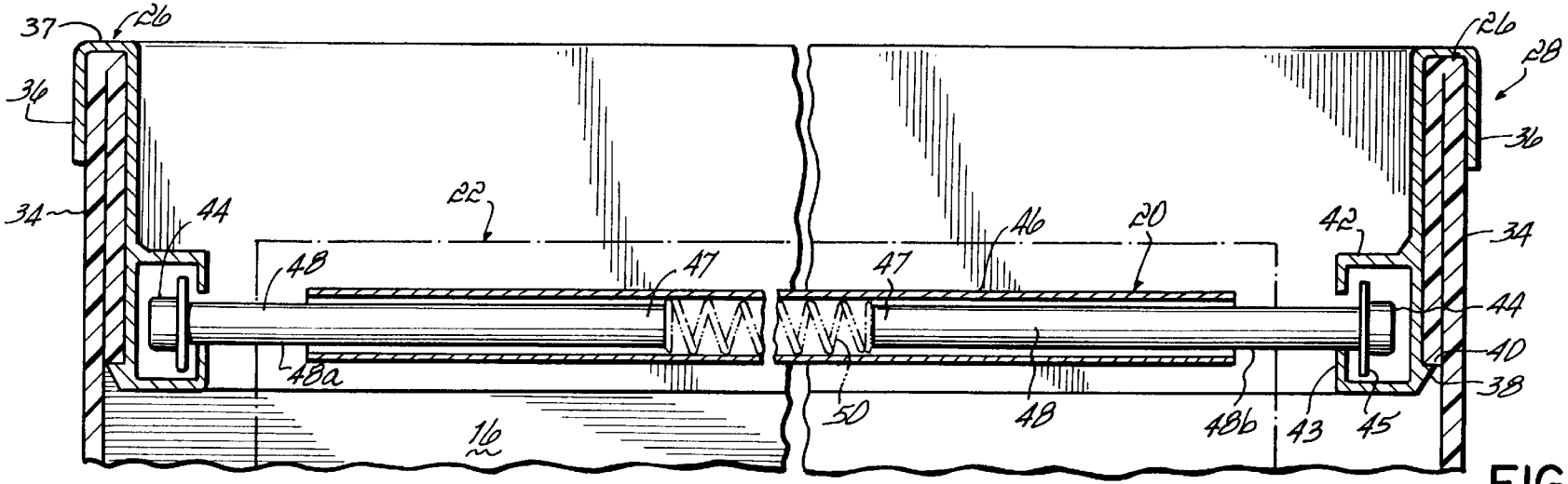
FIG. 2 is a cross-sectional view along lines 2—2 of FIG. 1 illustrating the extensible support bar.

Referring now to FIG. 2, one embodiment of the sleeve pack 12 of the invention includes sidewalls 16 which are folded over at their upper ends to provide a double-wall portion 34 along the top edge 26 of the sleeve pack and sidewall 16. The sidewall material may also be a thick, single-wall material, e.g., 10 mm thickness, which is preferable and is illustrated in FIGS. 6 and 7. When the material is thinner, e.g., 5 mm thickness, the double-wall portion 34 enhances the strength of the top edge 26 of the sleeve pack 12 and provides structural strength and support for the container cover (not shown). The elongated mounting structure 28 illustrated in FIGS. 2 and 3 is preferably formed of metal and comprises a curved hook section 36 which hooks over both sides of the double-wall portion 34. A 180° curve portion 37 of the hook section engages and covers the top edge 26. An outwardly extending ridge 38 is formed at the lower end of the mounting structure 28 and extends in the outward direction of hook section 36. When the hook section 36, and particularly curve portion 37, is placed over the top edge 26 of the sidewall 16, the ridge 38 engages a lower edge 40 of the double-wall portion 34 to secure mounting structure 28. Ridge 38 is spaced below hook section 36 and holds the curve portion 37 securely over the double-wall portion 34. The distance between the curve portion 37 and ridge 38 is preferably generally equal to the distance between edge 26 and edge 40 for a snug fit. The unique hook section 36 and ridge 38 make the mounting structure effectively snap into place when assembled without the need for external fasteners or other securing devices. The 180° curve portion 37 is illustrated as two 90° bends; however, a smother curve portion might also be utilized.

The mounting structure 28 further comprises a channel 42 which receives and supports the ends of the telescoping support bar 20. In the embodiment of the invention illustrated in FIG. 2, the channel has a C-shaped cross section and engages the support bar ends from above and below. Alternatively, the channel 42 may have an F-shaped cross-section or a J-shaped cross-section which engages the ends of the support bars 20 and suspends the bars in place.

The ends of the support bar 20 slide within the channels 42 so that the support bars 20 and the pouches 24 may be easily moved in the sleeve pack, such as to access products. The adjustable length of the telescoping support bar 20 provides smooth and easy movement of the bar 20 and prevents binding between the bar and channel 42 which occurs with traditional rigid support bars. Nut caps 44 are preferably placed at the ends of the support bar 20 to hold the bar ends in place within the channels 42. The upper and lower legs 43 of the channel 42 confine the flange 45 of cap 44 and thus confine the ends of bars 20. When the sleeve pack is assembled, the ends of the support bar 20 are slid into the channels 42 and the ends of the channels are capped or otherwise modified and sealed to keep the support bars from sliding out the ends of the channels 42. The unique shape of the mounting structure 28 and its interaction with the bars 20 ensures strong contact with the sleeve pack. The channel 42 is positioned below the hook section 36 and adjacent ridge 38. Therefore, the weight of the bars 20 and suspended pouches 22 pivot the structure 28 proximate hook section 36 and forces ridge 38 against edge 40.

In the embodiment of the telescoping support bar 20 illustrated in the drawings, the bar comprises an exterior cylindrical tube 46 which is formed of a metal such as aluminum or some other suitable material. For example, the exterior tube 46 might also be made of fiberglass or PVC plastic. Bar 20 includes two telescoping rods 48, each one positioned inside of an end of tube 46. The rods are preferably solid but may also be smaller diameter tubes. The opposing rods 48 smoothly and freely telescope within tube 46 to vary the length of the support bar 20 in accordance with the principles of the present invention.

Preferably, no biasing structure is utilized in the bar 20 and the rods 48 would simply be pushed in and pulled outwardly by channels 42 acting on the rod ends and caps 44 when the resilient sidewalls 16 return to their original position after being inwardly or outwardly dented. Without a biasing structure, the length of the support bar 20 is controlled exclusively by the movement of the sidewalls 16.

Alternatively, support bar 20 may include a biasing structure to return the bar to a desired length when it has been compressed or extended. For example, a compression spring 50, shown in phantom in FIGS. 2 and 3, may be placed inside of exterior tube 46 between the inner ends 47 of rods 48. The inner ends 47 of the rods 48 would engage spring 50, and compress the spring when the support bar 20 is compressed, such as by an inward force 30 on the sidewalls 16 (see FIG. 3). When the force is removed, the spring 50 would act on the rods 48 to telescope them outwardly in length so that the bar 20 returns to its original length and the sidewall 16 returns to its original shape. Another biasing structure might be utilized instead of a spring. For example, a compressible cylinder (not shown) might be utilized between rods 48.

FIG. 3 illustrates operation of the present invention during the application of force to a sidewall 16. For example, when an inward force is applied, as illustrated by arrows 30, sidewall 16 is dented inwardly moving channel 42*a* inwardly also. As may be seen on the left side of FIG. 3, the channel 42*a* engages the cap 44 and the end of rod 48*a* driving the rod 48*a* inwardly into the respective end of exterior tube 46. The opposite rod 48*b* is held in place by the respective channel 42*b*, and the driven rod 48*a* moves in tube 46 so that the support bar is shortened in its effective length. Thus, minimal outward resistance is provided by telescoping support bar 20 when sidewall 16 is dented or otherwise forced inwardly. The telescoping support bar absorbs the force and does not detrimentally affect the resiliency and flexibility of the sleeve pack sidewalls 16. Upon removal of the inward forces 30, the resilient sidewall 16 will return to its original shape and the rod 48 will be pulled outwardly of exterior tube 46 by the movement of channel 42 to return the support bar 20 to its original length. Since the support bars 20 telescope, the resilient give of the sidewall 16 is not jeopardized, and thus puncturing of the sidewalls is less likely to occur. Furthermore, telescoping support bar 20 does not hinder the sidewalls 16 from returning to their original shape. Traditional rigid support bars would resist force 30 and the deformation of sidewall 16 and would thus increase the incidence of the puncturing of the sidewall. In the past, if the force 30 was not sufficient to puncture sidewall 16, but was strong enough to overcome the rigidity of the ridge support bar, the support bar would bend and thereby hold the deformed or dented sidewall 16 in a permanently deformed state. The support bar would then have to be bent back into its extended length so that the sleeve pack was again reusable. As may be appreciated, such constant maintenance of sleeve packs is expensive and impractical.

If a compression spring 50 or other biasing structure is utilized, inward movement of the rods 48 would compress the structure 50 and the rods 48 would be biased to return to their original position.

While the Figures illustrate an inward force 30 on the sidewalls 16, an outward force from within the sleeve pack might also occur. The resilient sidewalls 16 and the telescoping support bar 20 would move as described above, except in an opposite direction, and permanent damage to the sleeve pack 12 is avoided. If a spring 50 is used, it may be unconnected from the ends 47 of the rods 48 and may only provide outward biasing. Alternatively, the rod ends 47 may be coupled to the spring 50 to provide an inward biasing of bar 20 when the sidewalls are pushed outwardly.

In accordance with another aspect of the present invention, the mounting structure 28 functions as an elongated protective edge rail for the sleeve pack 12. The hook section 36 of mounting structure 28 hooks over the top edge 26 of the sidewall 16 which will coincide with the top edge of the double-wall portion 34 if a thin layer of sidewall material is used instead of a thick layer as illustrated in FIGS. 6 and 7. The hook section 36 covers the top edge 26 and structurally strengthens the top edge to protect the edge from damage which might be incurred during use of the sleeve pack 12.

The unique shape of the one embodiment of the mounting structure including the opposing hook section 36 and ridge 38 provides a lightweight edge rail which may be fastened quickly and easily without external fasteners. Therefore, the mounting structure 28 in FIGS. 2 and 3 serves the dual function as an edge rail to protect and strengthen the top edge 26 of the sleeve pack 12 and also as a mount to support the ends of support bars 20 to suspend pouches within the sleeve pack.

The sleeve pack of the present invention is more damage resistant than has traditionally been possible and thus the overall container 10 may have a lighter and more inexpensive construction. Furthermore, the pouches 24 may be easily moved and manipulated within the sleeve pack for access to the products therein because the telescoping support bars 20 ensure smooth movement within channels 42 without binding the ends of the support bars.

Figure 4:
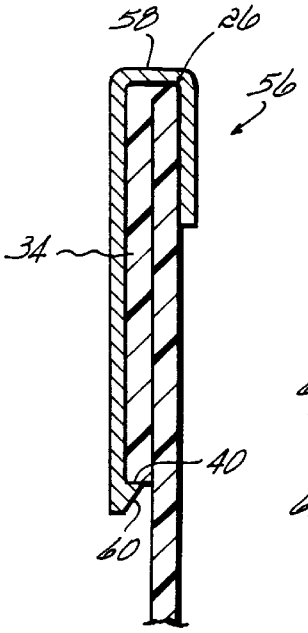
FIG. 4 is a cross-sectional view of an edge rail of the present invention along an edge of the sleeve pack.

Some sleeve packs are utilized without support bars and pouches wherein product is simply placed in the sleeve pack to rest on the base 14 and against the sidewalls 16. As illustrated in FIG. 4, the unique hook section 36 and ridge 38 of the mounting structure 28 might be utilized without channel 42 to strengthen the top edge 26 of the sleeve pack 12. The double-wall portion 34 is engaged by an edge rail structure 56 including a hook section 58 and an outwardly extending ridge 60. The hook section 58 includes a curve 59 which hooks over the top edge 26 of the sleeve pack 12 and double-wall portion 34 while the ridge 60 engages edge 40 of the double-wall portion 34. Therefore, the top edge 26 of the sleeve pack 12 is reinforced and structurally strengthened in those sleeve packs which do not utilize pouches 24 and support bars 20 and thus do not require channels 42 to be supported from the sidewalls. The edge rail structure 56 increases the durability of the sleeve pack and provides a more solid perimeter for engaging the cover (not shown) of the container 10. Similarly, the edge rail structure 56 might be utilized along a bottom edge of the sleeve pack for further increasing its durability and providing a more stable perimeter for coupling to base 14.

Figure 5:
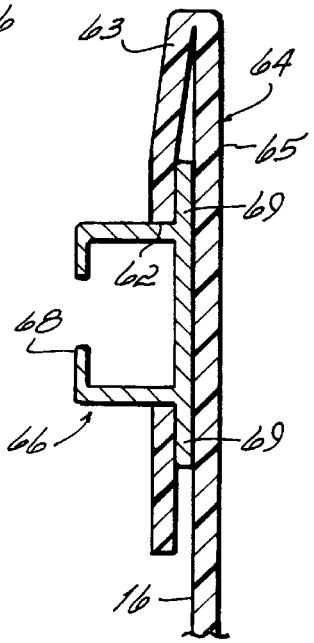
FIG. 5 is a cross-sectional view of an alternative embodiment of a mounting structure of the invention.

FIGS. 5, 6 and 7 illustrate alternative embodiments of the mounting structure utilized to support the ends of the support bars 20.

In FIG. 5, a slot 62 is formed on the inside wall 63 of a double-wall portion 64. A mounting structure 66 includes a C-shaped channel 68 to receive the support bar ends. Flanges 69 are formed on either side of channel 68 and the mounting structure 66 is slid into slot 62. The weight of the bars 20 and pouches 22 hold the mounting structure 66 securely within the double-wall portion 64 with the flanges 69 between the inner wall 63 and outer wall 65 of the double-wall portion 64.

Another alternative embodiment of the mounting structure is illustrated in FIG. 6 for use with a single wall sidewall material 71. Mounting structure 70 includes a C-shaped channel 72 and a flange 74 which projects upwardly from the channel 72. The flange 74 lies against the sidewall 71 and a rivet or bolt 76 extends through the flange 74 and sidewall 71 to secure the mounting structure 70 to the sidewall 71.

A still further alternative embodiment is illustrated in FIG. 7. Mounting structure 80 is somewhat similar to the mounting structures 28 illustrated in FIGS. 2 and 3. However, mounting structure 80 is preferably used with the single wall sidewall 71 and does not utilize a ridge 38 to engage an edge 40 of a double-wall portion. Instead a rivet or other fastener 82 extends through the sidewall 71 and through both sides of the hook section 84. The mounting structure 80 also functions as an edge rail to protect and strengthen the top edge 83 of the sidewall 71 as discussed hereinabove.

While each of the alternative embodiments illustrated in FIGS. 5, 6 and 7 utilize C-shaped channels, it will be understood by a person of ordinary skill in the art that other channels such as F-shaped channels or J-shaped channels might also be utilized to support the ends of support bars 20.

While the present invention has been illustrated by a description of various embodiments and while these embodiments have been described in considerable detail, it is not the intention of the applicants to restrict or in any way limit the scope of the appended claims to such detail.

Additional advantages and modifications will readily appear to those of ordinary skill in the art. The invention in its broader aspects is therefore not limited to the specific details, representative apparatus and method, and illustrative example shown and described. Accordingly, departures may be made from such details without departing from the spirit or scope of applicant's inventive concept.

What is claimed is:

1. A sleeve pack for storing and shipping products comprising:

a body for containing products having a top, a bottom and opposing sidewalls, the sidewalls of the body being generally flexible to provide an amount of give under a force applied thereto;

a telescoping support bar positioned in the body and spanning between the opposing sidewalls for suspending products in the body, the ends of the support bar operably coupled to the sidewalls for moving with the sidewalls to create a means for telescoping the support bar in length when the sidewalls flex inwardly and outwardly when force is applied thereto and further to create said means for telescoping the support bar generally to its original length when the force is removed and the sidewalls are returned to their original shape.

2. The sleeve pack of claim 1 further comprising mounting structures coupled to the opposite sidewalls and configured to receive opposite ends of the support bar to suspend the bar proximate the top of the body.

3. The sleeve pack of claim 2 wherein the sidewall is folded over to create a double wall portion along the top edge of the sidewall, the mounting structure including a hook section to hook over the double wall portion and including a ridge spaced from said hook section, the ridge engaging an edge of the double wall portion below the top edge of the sidewall to secure the mounting structure to the body.

4. The sleeve pack of claim 2 wherein the mounting structure includes an elongated track extending along the sidewall, the track movably coupling the end of the support bar to the sidewall so that the position of the bar in the body may be adjusted along the sidewall.

5. The sleeve pack of claim 1 further comprising a plurality of telescoping support bars extending between the sidewalls.

6. The sleeve pack of claim 1 further comprising a pouch for receiving and containing products, the pouch being coupled to the support bar at one end and hanging from the bar to suspend the products in the sleeve pack.

7. The sleeve pack of claim 1 wherein the telescoping support bar comprises a tube and a rod movable within an end of the tube to telescope the length of the support bar.

8. The sleeve pack of claim 7 wherein the bar includes a biasing device coupled between the tube and the rod to telescope the bar to an extended length when force is removed from the sleeve pack sidewalls.

9. The sleeve pack of claim 8 wherein the biasing device includes a spring.

10. The sleeve pack of claim 7 wherein the support bar further comprises a second rod movable within the tube at an end of the tube opposite the first rod, the movement of both rods telescoping the length of the bar.

11. The sleeve pack of claim 10 wherein the support bar further comprises a biasing device coupled between the two rods to telescope the bar when force is removed from the sleeve pack sidewalls.

12. A reusable container for storing and shipping products comprising:

a sleeve pack having a body for containing products, the body having a top, a bottom and opposing sidewalls and the sidewalls being generally flexible to provide an amount of give under a force applied thereto;

a base engaging the bottom of the sleeve pack body;

a cover engaging the top of the sleeve pack body to provide an enclosed container;

a telescoping support bar positioned in the sleeve pack body and spanning between the opposing sidewalls for suspending products within the container, the ends of the support bar operably coupled to the sidewalls for moving with the sidewalls to create a means for telescoping the support bar in length when the sleeve pack sidewalls flex inwardly and outwardly when force is applied thereto and further to create a means for telescoping the support bar generally to its original length when the force is removed and the sidewalls are returned to their original shape.

13. The sleeve pack of claim 12 further comprising mounting structures coupled to the opposite sidewalls and configured to receive opposite ends of the support bar to suspend the bar proximate the top of the body.

14. The sleeve pack of claim 13 wherein the mounting structure includes an elongated track extending along the sleeve pack sidewall, the track movably coupling the end of the support bar to the sidewall so that the position of the bar in the body may be adjusted along the sidewall.

15. The sleeve pack of claim 12 further comprising a plurality of telescoping support bars extending between the sidewalls.

16. The sleeve pack of claim 12 further comprising a pouch for receiving and containing products, the pouch being coupled to the support bar at one end and hanging from the bar to suspend the products in the sleeve pack.

17. The sleeve pack of claim 12 wherein the telescoping support bar comprises a tube and a rod movable within an end of the tube to telescope the length of the support bar.

18. The sleeve pack of claim 17 wherein the bar includes a biasing device coupled between the tube and the rod to telescope the bar to an extended length when force is removed from the sleeve pack sidewalls.

19. The sleeve pack of claim 18 wherein the biasing device includes a spring.

20. The sleeve pack of claim 17 wherein the support bar further comprises a second rod movable within the tube at an end of the tube opposite the first rod, the movement of both rods telescoping the length of the bar.

21. The sleeve pack of claim 20 wherein the support bar further comprises a biasing device coupled between the two rods to telescope the bar when force is removed from the sleeve pack sidewalls.

* * * * *